US009951670B2

(12) United States Patent
Kato et al.

(10) Patent No.: US 9,951,670 B2
(45) Date of Patent: Apr. 24, 2018

(54) EXHAUST GAS PURIFICATION APPARATUS OF INTERNAL COMBUSTION ENGINE

(71) Applicant: Toyota Jidosha Kabushiki Kaisha, Toyota-shi Aichi-ken (JP)

(72) Inventors: Akira Kato, Shizuoka-ken (JP); Yoshiyuki Sakamoto, Nagakute (JP); Yasutaka Nagai, Nagakute (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 15/148,576

(22) Filed: May 6, 2016

(65) Prior Publication Data

US 2016/0326927 A1 Nov. 10, 2016

(30) Foreign Application Priority Data

May 8, 2015 (JP) ..... 2015-095830

(51) Int. Cl.

| | |
|---|---|
| ***F01N 3/00*** | (2006.01) |
| ***F01N 3/08*** | (2006.01) |
| ***F02D 41/02*** | (2006.01) |
| ***F02D 41/14*** | (2006.01) |
| ***F02D 41/20*** | (2006.01) |

(52) U.S. Cl.

CPC ..... *F01N 3/0892* (2013.01); *F01N 3/0842* (2013.01); *F01N 3/0871* (2013.01); *F02D 41/0275* (2013.01); *F02D 41/1475* (2013.01); *F02D 41/20* (2013.01); *F01N 2240/04* (2013.01); *F02D 2200/0802* (2013.01)

(58) Field of Classification Search

CPC .. F01N 3/0892; F01N 224/04; F01N 2240/34; B01D 53/326; B01D 53/925

See application file for complete search history.

(56) References Cited

U.S. PATENT DOCUMENTS

2006/0118409 A1* 6/2006 Awano ..... B01D 53/8631 204/267
2009/0145108 A1* 6/2009 Koide ..... B01D 53/326 60/275

FOREIGN PATENT DOCUMENTS

| | | | |
|---|---|---|---|
| EP | 2223735 | A1 | 5/2009 |
| JP | 2009-112967 | A | 5/2009 |
| JP | 2010-185347 | A | 8/2010 |

(Continued)

*Primary Examiner* — Mark Laurenzi
*Assistant Examiner* — Jason Sheppard
(74) *Attorney, Agent, or Firm* — Dinsmore & Shohl LLP

(57) ABSTRACT

An exhaust gas purification apparatus for an internal combustion engine, includes an oxygen ion conductor which can conduct oxygen ions when a voltage is applied to the conductor and a NOx absorption/discharge device. The NOx absorption/discharge device is formed by a first electrode provided on a first surface of the oxygen ion conductor and a second electrode including silver and provided on a second surface of the oxygen ion conductor opposite to the first surface across the oxygen ion conductor. The apparatus applies a voltage between the first and second electrodes such that oxygen ions move through the oxygen ion conductor from the first electrode toward the second electrode when satisfied is a purification condition that nitrogen oxide discharged from the NOx absorption/discharge device can be purified in the exhaust passage.

7 Claims, 9 Drawing Sheets

(56) References Cited

FOREIGN PATENT DOCUMENTS

| | | | |
|---|---|---|---|
| JP | 2013-233504 | A | 11/2013 |
| JP | 2016-014376 | A | 1/2016 |

* cited by examiner

EXHAUST GAS PURIFICATION APPARATUS OF INTERNAL COMBUSTION ENGINE

CROSS-REFERENCE TO RELATED APPLICATIONS

The present application claims priority to Japanese patent application No. 2015-095830 filed May 8, 2015, which is herein incorporated by reference in its entirety including the specification, drawings and abstract.

BACKGROUND

Technical Field

The present disclosure relates to an exhaust gas purification apparatus of an internal combustion engine provided with a NOx absorption/discharge device which can absorb nitrogen oxide (NOx) included in an exhaust gas and discharge the absorbed nitrogen oxide.

Description of the Related Art

An exhaust gas purification apparatus for purifying nitrogen oxide discharged from an internal combustion engine is described in JP 2009-112967 A. This exhaust gas purification apparatus (hereinafter, will be referred to as "the conventional device") comprises adsorption means and purification means provided in an exhaust passage. The adsorption means adsorbs the nitrogen oxide thereon and the purification means reduces the nitrogen oxide to purify the nitrogen oxide.

The adsorption means is provided in the exhaust passage upstream of the purification means. The purification means can purify the nitrogen oxide when a temperature of the purification means is relatively high. The nitrogen oxide adsorbs on the adsorption means when a temperature of the adsorption means is relatively low. In particular, the nitrogen oxide adsorbs on the adsorption means when the temperature of the adsorption means is a temperature which corresponds to the temperature of the purification means when the purification means cannot purify the nitrogen oxide. On the other hand, the nitrogen oxide adsorbing on the adsorption means desorbs from the adsorption means when the temperature of the adsorption means becomes high. In particular, the nitrogen oxide adsorbing on the adsorption means desorbs from the adsorption means when the temperature of the adsorption means becomes a temperature which corresponds to the temperature of the purification means when the purification means can purify the nitrogen oxide.

According to the conventional device, when the temperature of the purification means is relatively low, in particular, when the temperature of the purification means is a temperature, at which the purification means cannot purify the nitrogen oxide, the nitrogen oxide included in the exhaust gas adsorbs on the adsorption means.

When the temperature of the purification means becomes high, in particular, when the temperature of the purification means becomes a temperature, at which the purification means can purify the nitrogen oxide, the nitrogen oxide adsorbing on the adsorption means desorbs from the adsorption means and then, flows into the purification means. Thereby, the nitrogen oxide is purified by the purification means.

SUMMARY OF THE INVENTION

As described above, according to the conventional device, the desorption of the nitrogen oxide from the adsorption means depends on the temperature of the adsorption means.

In this case, it is not possible to optionally cause the nitrogen oxide to desorb from the adsorption means. Therefore, when the purification means cannot purify the nitrogen oxide, the nitrogen oxide may desorb from the adsorption means and as a result, a NOx purification rate achieved by the conventional device may decrease.

The present disclosure has been made for addressing this problem. In particular, one of objects of the present disclosure is to provide an exhaust gas purification apparatus of an internal combustion engine which can optionally cause nitrogen oxide from a NOx absorption/discharge device for absorbing nitrogen oxide included in an exhaust gas and discharging the absorbed nitrogen oxide.

In this regard, the inventors of this application have realized as follows. When the NOx absorption/discharge device comprises an oxygen ion conductor formed of oxygen ion material which can conduct oxygen ions when an electric voltage is applied to the oxygen ion material, a first electrode provided on a first surface of the oxygen ion conductor and a second electrode including silver and provided on a second surface of the oxygen ion conductor opposite to the first surface across the oxygen ion conductor, nitrogen oxide reacts with the silver of the second electrode and thereby, is absorbed in the second electrode. When an electric voltage is applied between the first and second electrodes such that oxygen ions move in the oxygen ion conductor from the first electrode toward the second electrode, the nitrogen oxide absorbed in the second electrode is discharged from the second electrode.

On the basis of this realization, the exhaust gas purification apparatus according to the present disclosure (hereinafter, will be referred to as "the disclosure device") comprises the NOx absorption/discharge device in an exhaust passage of the engine. In addition, the disclosure device comprises an electric voltage source for applying an electric voltage between the first and second electrodes and a control section for controlling an operation of the electric voltage source.

The control section is configured to control the operation of the electric voltage source to apply an electric voltage between the first and second electrodes such that oxygen ions move through the oxygen ion conductor from the first electrode toward the second electrode when satisfied is a purification condition which the nitrogen oxide discharged from the NOx absorption/discharge device can be purified in the exhaust passage.

Thereby, the discharge of the nitrogen oxide from the NOx absorption/discharge device can be controlled by controlling the application of the electric voltage between the first and second electrodes. In other words, it is possible to optionally discharge the nitrogen oxide from the NOx absorption/discharge device. Therefore, it is possible to assuredly discharge the nitrogen oxide from the NOx absorption/discharge device when the nitrogen oxide discharged from the NOx absorption/discharge device can be purified, that is, when the purification condition is satisfied. Thus, the NOx purification rate of the disclosure device can be improved.

The control section may be configured:

to execute an enriching control for making an air/fuel ratio of an exhaust gas flowing into the NOx absorption/discharge device richer than the stoichiometric air/fuel ratio when a predetermined start condition is satisfied; and to determine that the purification condition is satisfied when satisfied is a rich air/fuel ratio condition that it is estimated that the air/fuel ratio of the exhaust gas flowing into the absorption/discharge device is made to be richer than the stoichiometric air/fuel ratio by the execution of the enriching control.

Thereby, the nitrogen oxide discharged from the NOx absorption/discharge device can be reduced to be purified by reduction component (for example, hydrocarbon) included in the exhaust gas flowing into the NOx absorption/discharge device.

Further, if accurately knowing that the air/fuel ratio of the exhaust gas flowing into the NOx absorption/discharge device is made to be richer than the stoichiometric air/fuel ratio by the execution of the enriching control, it is possible to improve the NOx purification rate of the disclosure device.

In this connection, the inventors of this application have realized that even when the electric voltage is not applied between the electrodes, an electric current flows between the first and second electrodes when the exhaust gas having an air/fuel ratio richer than the stoichiometric air/fuel ratio reaches the NOx absorption/discharge device. The reason that such a phenomena occurs is estimated as follows. When the exhaust gas having an air/fuel ratio richer than the stoichiometric air/fuel ratio reaches the NOx absorption/discharge device, the hydrocarbon included in the exhaust gas burns at the second electrode while the silver of the second electrode serves as a catalyst. At this time, a chemical reaction shown by a following chemical reaction formula (1) proceeds at the second electrode. Thus, even when the electric voltage is not applied between the electrodes, oxygen ions move through the oxygen ion conductor from the first electrode toward the second electrode and thus, an electric current flows between the electrodes.

$$2C_xH_y+(4x+y)O^{2-}\rightarrow 2xCO_2+yH_2O+(8x+2y)e^- \quad (1)$$

On the basis of this realization, the control section may be configured to determine that the rich air/fuel ratio condition is satisfied when an electric current flowing between the first and second electrodes is equal to or larger than a predetermined current value after the execution of the enriching control is started.

Thereby, it is possible to know that the exhaust gas having the rich air/fuel reaches the NOx absorption/discharge device, in particular, the second electrode and as a result, further improve the NOx purification rate of the disclosure device.

In case that the disclosure device further comprises a NOx purification catalyst provided in the exhaust passage downstream of the NOx absorption/discharge device, the control section may be configured to determine that the purification condition is satisfied when a purification rate correlation value correlating with a NOx purification rate of the NOx purification catalyst is equal to or larger than a predetermined purification rate correlation value. In this case, the purification rate correlation value when the NOx purification rate corresponds to a first purification rate, is smaller than the purification rate correlation value when the NOx purification rate corresponds to a second purification rate larger than the first purification rate.

Thereby, the nitrogen oxide discharged from the NOx absorption/discharge device is purified by the NOx purification catalyst.

Further, if the nitrogen oxide is discharged from the NOx absorption/discharge device when the purification condition is not satisfied, the NOx purification rate of the disclosure device decreases. In this connection, the inventors of this application have realized that the discharge of the nitrogen oxide from the second electrode can be prevented when an electric voltage is applied between the first and second electrodes such that oxygen ions move through the oxygen ion conductor from the second electrode toward the first electrode.

On the basis of this realization, the control section may be configured to control the operation of the electric voltage source to apply an electric voltage between the first and second electrodes such that oxygen ions move through the oxygen ion conductor from the second electrode toward the first electrode when the purification condition is not satisfied.

Thereby, when the purification condition is not satisfied, the discharge of the nitrogen oxide from the NOx absorption/discharge device can be prevented and thus, the decrease of the NOx purification rate of the disclosure device can be prevented.

In the above description, for facilitating understanding of the present disclosure, elements of the present disclosure corresponding to elements of an embodiment described later are denoted by reference symbols used in the description of the embodiment accompanied with parentheses. However, the elements of the present disclosure are not limited to the elements of the embodiment defined by the reference symbols. The other objects, features and accompanied advantages of the present disclosure can be easily understood from the description of the embodiment of the present disclosure along with the drawings.

DESCRIPTION OF THE PREFERRED EMBODIMENTS

Figure 1:
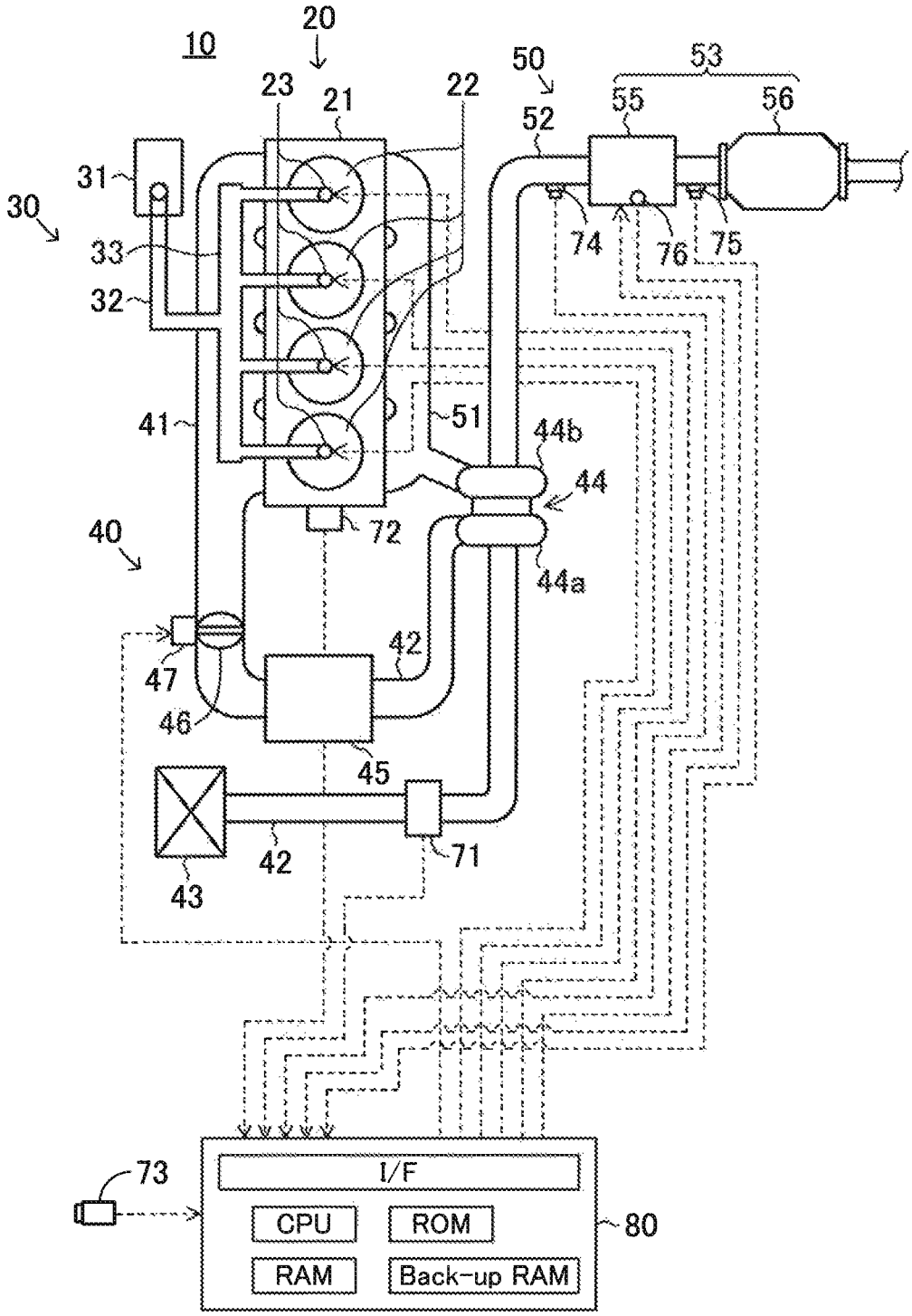
FIG. 1 shows a general view of an internal combustion engine provided with an exhaust gas purification apparatus according to an embodiment of the present disclosure.

Below, an exhaust gas purification apparatus of an internal combustion engine according to an embodiment of the present disclosure will be described with reference to the drawings. The exhaust gas purification apparatus according to the embodiment is applied to an internal combustion engine 10 shown in FIG. 1. The engine 10 is a multi-cylinder (in this embodiment, linear-four-cylinder) four-cycle piston-reciprocating type diesel engine. The engine 10 includes an engine body part 20, a fuel supply system 30, an intake system 40 and an exhaust system 50.

The engine body part 20 includes a body 21 including a cylinder block, a cylinder head, a crank case and the like. Four combustion chambers 22 are formed in the body 21. Four fuel injectors 23 are provided in an upper portion of each of the combustion chambers 22. The fuel injectors 23 open in response to commands sent from an engine ECU (i.e., an engine electronic control unit) 80 described later to inject fuel directly into the combustion chambers 23.

The fuel supply system 30 includes a fuel pressurizing pump 31 or a supply pump 31, a fuel delivery pipe 32 and a common rail 33 or an accumulation chamber 33. A discharge outlet of the supply pump 31 is connected in communication manner with the fuel delivery pipe 32. The fuel delivery pipe 32 is connected in communication manner with the common rail 33. The common rail 33 is connected in communication manner with the fuel injectors 23. The supply pump 31 suctions fuel reserved in a fuel tank (not shown) and pressurizes the fuel. Then, the supply pump 31 supplies the pressurized fuel having a high pressure to the common rail 33 through the fuel delivery pipe 32.

The intake system 40 includes an intake manifold 41, an intake pipe 42, an air cleaner 43, a compressor 44*a* of a turbocharger 44, an intercooler 45, a throttle valve 46 and a throttle valve actuator 47.

The intake manifold 41 includes branch portions each connected to the respective combustion chamber 22 and a collection part on which the branch portions converge. The intake pipe 42 is connected in communication manner with the intake manifold 41. The intake manifold 41 and the intake pipe 42 form an intake passage. The air cleaner 43, the compressor 44*a*, the intercooler 45 and the throttle valve 46 are provided in the intake pipe 42 in order from an upstream side in a direction of a flow of an intake air to a downstream side in the direction of the flow of the intake air. The throttle valve actuator 47 changes an opening degree of the throttle valve 46 in response to a command sent from the ECU 80.

The exhaust system 50 includes an exhaust manifold 51, an exhaust pipe 52, a turbine 44*b* of the turbocharger 44 and an exhaust gas purification apparatus 53.

The exhaust manifold 51 includes branch portions each connected to the respective combustion chamber 22 and a collection portion on which the branch portions converge. The exhaust pipe 52 is connected in communication manner with the exhaust manifold 51. The exhaust manifold 51 and the exhaust pipe 52 form an exhaust passage. The turbine 44*b* and the exhaust gas purification apparatus 53 are provided in the exhaust pipe 52 in order from an upstream side in a direction of a flow of an exhaust gas to a downstream side in the direction of the flow of the exhaust gas.

The exhaust gas purification apparatus 53 includes an electric NOx absorption/discharge device 55 and a diesel particulate filter 56 in order from an upstream side in the direction of the flow of the exhaust gas to a downstream side in the direction of the flow of the exhaust gas. Hereinafter, the electric NOx absorption/discharge device 55 will be referred to as "the adsorption device 55" and the diesel particulate filter 56 will be referred to as "the DPF 56". The DPF 56 traps particulates included in the exhaust gas.

Figure 2A:
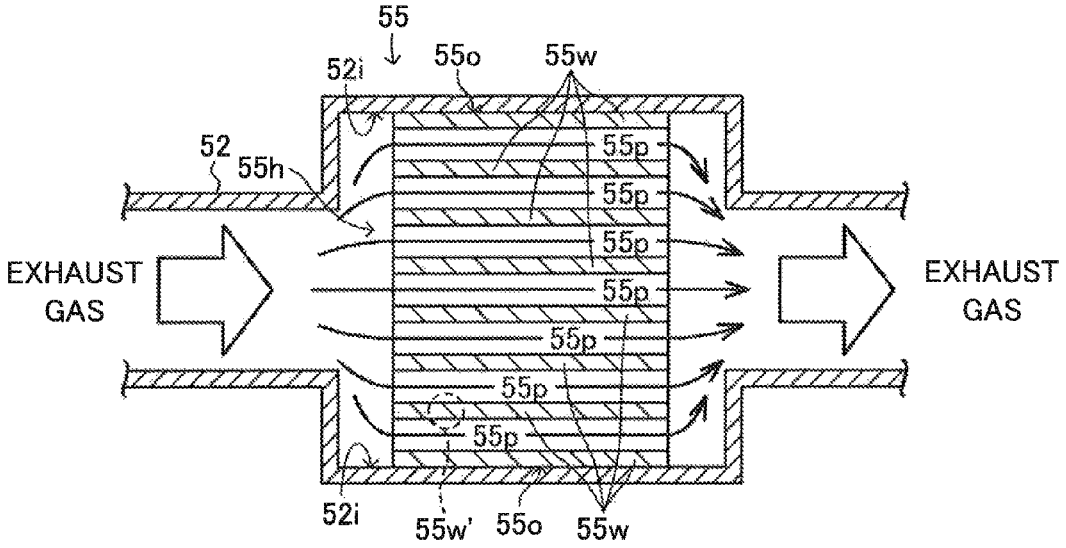
FIG. 2(A) shows an enlarged sectional view of an electric NOx absorption/discharge device shown in FIG. 1.

As shown in FIG. 2(A), the absorption device 55 includes a member 55*h* having a so-called honeycomb structure which includes passages 55*p* defined by partition walls 55*w* extending parallel to each other and partition walls (not shown) extending perpendicular to the partition walls 55*w*. Hereinafter, the member 55*h* will be referred to as "the honeycomb member 55*h*".

The honeycomb member 55*h* is provided in the exhaust pipe 52. In particular, the honeycomb member 55*h* is provided in the exhaust pipe 52 such that an entire peripheral outer wall surface 55*o* of the honeycomb member 55*h* contacts an entire peripheral inner wall surface 52*i* of the exhaust pipe 52 tightly. An exhaust gas flowing through the exhaust pipe 52 flows through the passages 55*p* of the honeycomb member 55*h* and then, flows out from the honeycomb member 55*h*.

Figure 2B:
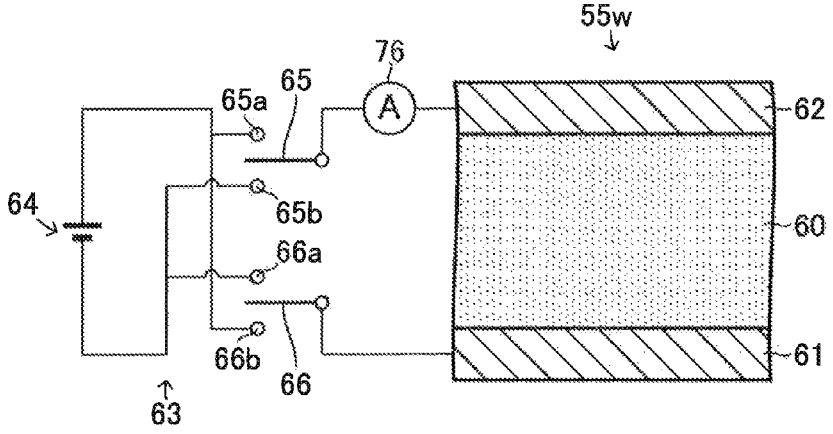
FIG. 2(B) shows an enlarged sectional view of a partition wall of the electric NOx absorption/discharge device shown in FIG. 2(A).

As shown in FIG. 2(B) illustrating a portion 55*w*' of the partition wall 55*w* enclosed by a chain line in FIG. 2(A), each of the partition walls 55*w* of the absorption device 55 is formed by a solid electrolyte layer (i.e., a solid electrolyte part) 60, a first electrode layer (i.e., a first electrode) 61, a second electrode layer (i.e., a second electrode) 62 and an electric power source circuit (i.e., an electric power source) 63.

The solid electrolyte layer 60 is formed of a known porous solid electrolyte having an oxygen ion conductivity, for example, scandia stabilized zirconia (ScSZ) or yttria stabilized zirconia (YSZ).

The first electrode layer 61 is provided on one of surfaces of the solid electrolyte layer 60. The first electrode layer 61 is formed of porous material of cermet of scandia stabilized zirconia (ScSZ) and metal oxide (except for oxide including silver) or cermet of scandia stabilized zirconia (ScSZ) and metal (except for silver). The second electrode layer 62 is provided on the surface of the solid electrolyte layer 60 opposite to the first electrode layer 61 across the solid electrolyte layer 60. The second electrode layer 62 is formed of porous material of cermet of scandia stabilized zirconia (ScSZ) and silver oxide or cermet of scandia stabilized zirconia (ScSZ) and silver.

As shown in FIG. 2(B), the electric power source circuit 63 includes a direct current electric power source (i.e., an electric voltage source) 64, a first switch 65, a second switch 66 and an ammeter 76.

Figure 3A:
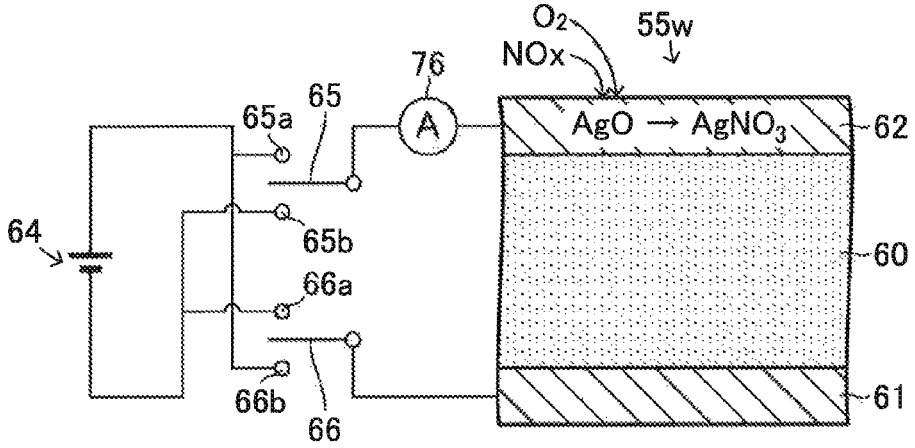
FIG. 3(A) shows a view similar to FIG. 2(B) which illustrates the partition wall of the electric NOx absorption/discharge device when no electric voltage is applied between electrodes.
Figure 3B:
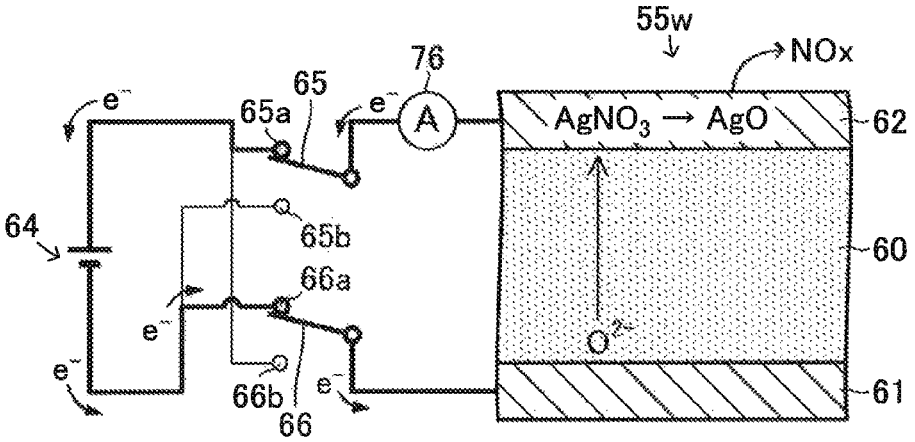
FIG. 3(B) shows a view similar to FIG. 2(B) which illustrates the partition wall of the electric NOx absorption/discharge device when a normal electric voltage is applied between the electrodes.

In this embodiment, as shown in FIG. 3(B), when the first switch 65 is electrically connected to a terminal 65*a* and the second switch 66 is electrically connected to a terminal 66*a*, formed is a direct current circuit where a direct current flows through the direct current electric power source 64, the first switch 65, the ammeter 76, the second electrolyte layer 62, the solid electrolyte layer 60, the first electrode layer 61 and the second switch 66 in order.

Figure 3C:
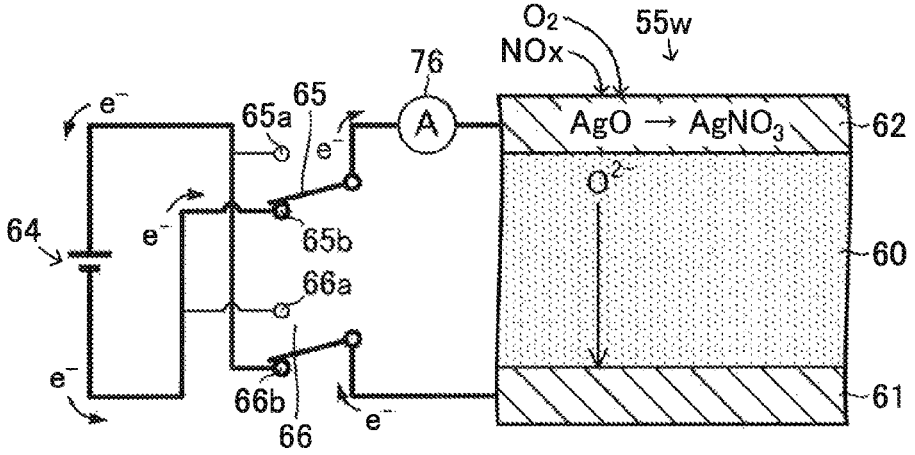
FIG. 3(C) shows a view similar to FIG. 2(B) which illustrates the partition wall of the electric NOx absorption/discharge device when an inverse electric voltage is applied between the electrodes.

On the other hand, as shown in FIG. 3(C), when the first switch 65 is electrically connected to a terminal 65*b* and the second switch 66 is electrically connected to a terminal 66*b*, formed is a direct current circuit where a direct current flows through the direct current electric power source 64, the second switch 66, the first electrode layer 61, the solid electrolyte layer 60, the second electrolyte layer 62, the ammeter 76 and the first switch 65 in order.

Again, referring to FIG. 1, the ECU 80 is an electronic circuit including a known microcomputer. The ECU 80 includes a CPU, a ROM, a RAM, a back-up RAM, an interface and the like. The ECU 80 is electrically connected to sensors described later and receives signals from the sensors. In addition, the ECU 80 sends command signals or drive signals to various actuators and the switches 65 and 66 of the electric power source circuit 63.

The ECU 80 is electrically connected to an air flow meter 71, a crank angle sensor 72, an acceleration pedal depression amount sensor 73, an air/fuel ratio sensor 74, a NOx concentration sensor 75 and the ammeter 76 of the electric power source circuit 63 of the absorption device 55 (see FIG. 2(B)).

The air flow meter 71 is provided in the intake pipe 42 upstream of the compressor 44*a* with respect to the direction of the flow of the intake air. The air flow meter 71 measures a mass flow rate of air passing through the air flow meter 71 (i.e., an intake air amount Ga) and outputs a signal depending on the intake air amount Ga. The ECU 80 acquires an intake air amount Ga on the basis of this signal.

The crank angle sensor 72 is provided in the body 21 proximal to a crank shaft (not shown) of the engine 10. The crank angle sensor 72 outputs a pulse signal each time the crank shaft rotates by a constant angle (in this embodiment, 10 degrees). The ECU 80 acquires a crank angle (i.e., an absolute crank angle) of the engine 10 with respect to the compression top dead center of the predetermined combustion chamber on the basis of the pulse signal and a signal sent from a cam position sensor (not shown). In addition, the ECU 80 acquires an engine speed NE on the basis of the pulse signals sent from the crank angle sensor 72.

The acceleration pedal depression amount sensor 73 detects a depression amount of an acceleration pedal (now shown) (i.e., an acceleration pedal depression amount Accp) and outputs a signal expressing the acceleration pedal depression amount Accp.

The air/fuel ratio sensor 74 is provided in the exhaust pipe 52 between the turbine 44*b* and the absorption device 55. The air/fuel ratio sensor 74 detects an oxygen concentration of the exhaust gas reaching the air/fuel ratio sensor 74 and outputs a signal depending on the oxygen concentration. The ECU 80 acquires an air/fuel ratio AFex of the exhaust gas reaching the air/fuel ratio sensor 74 on the basis of this signal.

The NOx concentration sensor 75 is provided in the exhaust pipe 52 between the absorption device 55 and the DPF 56. The NOx concentration sensor 75 detects a NOx concentration of the exhaust gas reaching the NOx concentration sensor 75 and outputs a signal depending on the NOx concentration. The ECU 80 acquires a NOx concentration Cnox of the exhaust gas reaching the NOx concentration sensor 75 on the basis of this signal.

The ammeter 76 detects an electric current flowing through the solid electrolyte layer 60 of the absorption device 55 and outputs a signal expressing a value of the electric current lad. The ECU 80 acquires an electric current lad flowing through the solid electrolyte layer 60 on the basis of this signal.

<Function of Absorption Device>

As shown in FIG. 3(A), in the absorption device 55, when no electric voltage is applied between the first and second electrode layers 61 and 62, nitrogen oxide (in particular, nitrogen monoxide) included in the exhaust gas is absorbed in the second electrode layer 62 through a chemical reaction shown by a following chemical reaction formula (2).

$$2AgO+2NO+O_2 \rightarrow 2AgNO_3 \quad (2)$$

Regarding this function of the absorption device 55, the inventors of this application have realized as follows. As shown in FIG. 3(B), when the first switch 65 is electrically connected to the terminal 65*a* and the second switch 66 is electrically connected to the terminal 66*a*, an electric voltage is applied between the first and second electrode layers 61 and 62 such that oxygen ions ($O^{2-}$) move through the solid electrolyte layer 60 from the first electrode layer 61 toward the second electrolyte layer 62. Hereinafter, the electric voltage applied in this case will be referred to as "the normal electric voltage".

When the normal electric voltage is applied between the electrode layers 61 and 62, oxygen ions produced at the first electrode layer 61 reach the second electrode layer 62 through the solid electrolyte layer 60. Thereby, the oxygen ions are supplied to the second electrolyte layer 62. Thus, a chemical reaction shown by a following chemical reaction formula (3) proceeds. Therefore, NOx (in particular, nitrogen monoxide) absorbed in the second electrode layer 62 is discharged or desorbs from the second electrolyte layer 62.

$$2AgNO_3+2O^{2-} \rightarrow 2AgO+2NO+2O_2+4e^- \quad (3)$$

As described above, the inventors of this application have realized that it is possible to cause the nitrogen oxide absorbed in the second electrode layer 62 to desorb from the second electrode layer 62 by applying the normal electric voltage between the first and second electrode layers 61 and 62. In this case, as an absolute value of the normal electric voltage increases, an amount of the nitrogen oxide desorbing from the second electrode layer 62 per unit time increases.

In addition, the inventors of this application have realized as follows. As shown in FIG. 3(C), when the first switch 65 is electrically connected to the terminal 65*b* and the second switch 66 is electrically connected to the terminal 66*b*, an electric voltage is applied between the first and second electrode layers 61 and 62 such that oxygen ions move through the solid electrolyte layer 60 from the second electrode layer 62 toward the first electrolyte layer 61. Hereinafter, the electric voltage applied in this case will be referred to as "the inverse electric voltage".

When the inverse electric voltage is applied between the electrode layers 61 and 62, electrons ($e^-$) are supplied to the second electrolyte layer 62. Thus, a chemical reaction shown by a following chemical reaction formula (4) proceeds. In other words, the chemical reaction shown by the chemical reaction formula (3) is unlikely to proceed. Therefore, the nitrogen oxide absorbed in the second electrode layer 62 is unlikely to desorb from the second electrolyte layer 62.

$$2AgNO+2NO+2O_2+4e^- \rightarrow 2AgNO_3+2O^{2-} \quad (4)$$

As described above, the inventors of this application have realized that it is possible to prevent the nitrogen oxide from desorbing (being discharged) from the second electrode layer 62 by applying the inverse electric voltage between the first and second electrodes 61 and 62. In this case, as the absolute value of the inverse electric voltage increases, an effect of preventing the desorption of the nitrogen oxide from the second electrode layer 62 increases.

As described later in detail, on the basis of the realization of the inventors of this application, the exhaust gas purification apparatus according to this embodiment is configured to execute a NOx purification control for purifying the nitrogen oxide included in the exhaust gas discharged from the combustion chambers 22 to the exhaust passage.

As described above, according to this embodiment, the solid electrolyte layer 60 is an oxygen ion conductor formed of an oxygen ion conductive material which can conduct oxygen ions when an electric voltage is applied to the oxygen ion conductive material and the NOx absorption/discharge device is formed by the solid electrolyte layer 60, the first electrode layer 61 and the second electrolyte layer 62.

<Summary of NOx Purification Control by Exhaust Gas Purification Device>

Next, a summary of the NOx purification control executed by the exhaust gas purification apparatus according to this embodiment will be described with reference to FIG. 4. Hereinafter, a temperature of the absorption device 55 will be referred to as "the absorption device temperature", the nitrogen oxide absorbed in the absorption device 55 will be referred to as "the absorbed nitrogen oxide" and the air/fuel ratio of the exhaust gas flowing into the absorption device 55 will be referred to as "the inflow exhaust gas air/fuel ratio".

When the absorption device temperature Tad is high, the absorbed nitrogen oxide is unlikely to desorb from the absorption device 55. Further, when the inflow exhaust gas air/fuel ratio AFex becomes the stoichiometric air/fuel ratio or richer than the stoichiometric air/fuel ratio, the absorbed nitrogen oxide is likely to desorb from the absorption device 55. Therefore, the nitrogen oxide may be discharged from the absorption device 55 when the absorption device temperature Tad and the inflow exhaust gas air/fuel ratio AFex are certain values, respectively.

Accordingly, the exhaust gas purification apparatus according to this embodiment applies the inverse electric voltage Vi between the first and second electrode layers 61 and 62 as shown in FIG. 3(C) (see a time t40 in FIG. 4) when the NOx concentration Cnox detected by the NOx concentration sensor 75 becomes larger than zero. Thereby, it is possible to prevent the nitrogen oxide from being discharged from the second electrolyte layer 62. Hereinafter, the NOx concentration Cnox detected by the NOx concentration sensor 75 will be referred to as "the detected NOx concentration Cnox".

Further, when an amount of the nitrogen oxide absorbed in the second electrode layer 62 increases, the nitrogen oxide is likely to desorb from the absorption device 55. Therefore, even when the constant inverse electric voltage Vi is applied between the first and second electrode layers 61 and 62, the nitrogen oxide may desorb from the absorption device 55. Accordingly, the exhaust gas purification apparatus according to this embodiment increases the inverse electric voltage Vi each time the exhaust gas purification apparatus detects that the detected NOx concentration Cnox is larger than zero (see a period from the time t40 to a time t41 in FIG. 4). Hereinafter, the amount of the nitrogen oxide absorbed in the second electrode layer 62 will be referred to as "the absorbed nitrogen oxide amount".

Figure 4:
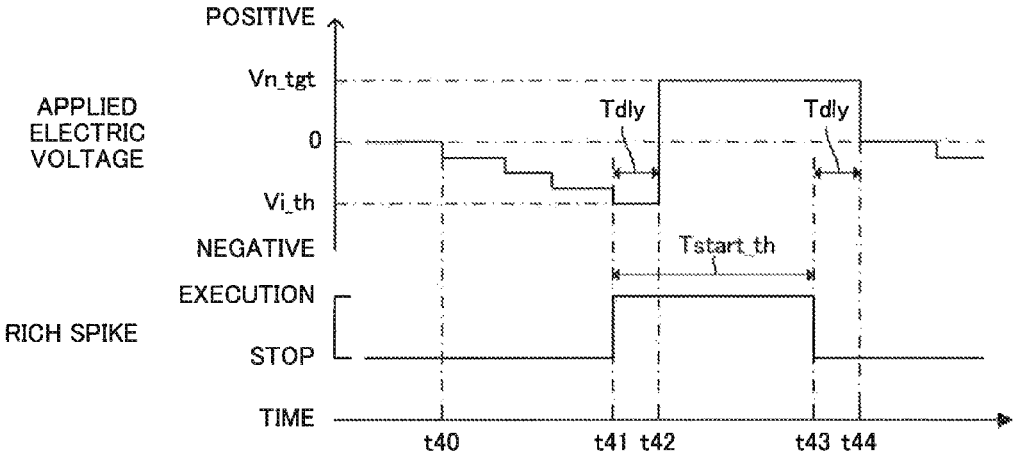
FIG. 4 shows a time chart which illustrates an electric voltage applied to the electric NOx absorption/discharge device shown in FIGS. 1 and 2, etc.

Then, when the absolute value of the inverse electric voltage Vi reaches a predetermined threshold voltage Vi_th (i.e., when a predetermined enriching control start condition is satisfied), the exhaust gas purification apparatus according to this embodiment starts an execution of a rich spike control (i.e., an enriching control) (see the time t41 in FIG. 4). In this embodiment, the predetermined threshold voltage Vi_th is set to an electric voltage smaller than an electric voltage, at which oxygen atom of material forming the solid electrolyte layer 60 (i.e., oxygen atom of the solid electrolyte) is ionized, in other words, at which chemical decomposition of the solid electrolyte layer 60 occurs.

Further, according to the rich spick control, a predetermined amount of the fuel is injected from each of the fuel injectors 23 at the exhaust stroke in each of the combustion chambers 22. The predetermined amount is set to an amount capable of making the air/fuel ratio of the exhaust gas discharged from the combustion chambers 22 richer than the stoichiometric air/fuel ratio.

Therefore, when the rich spike control is executed, the exhaust gas having an air/fuel ratio richer than the stoichiometric air/fuel ratio is discharged from the combustion chambers 22 to the exhaust passage. Then, this exhaust gas flows into the absorption device 55. Hereinafter, the exhaust gas having an air/fuel ratio richer than the stoichiometric air/fuel ratio will be referred to as "the rich gas".

On the other hand, as shown in FIG. 3(B), at a time when a predetermined time Tdly elapses after the execution of the rich spike control is started, the exhaust gas purification apparatus according to this embodiment applies the normal electric voltage Vn having a predetermined value Vn_tgt to the absorption device 55 (see a time t42 in FIG. 4). Thereby, the nitrogen oxide is caused to be discharged from the absorption device 55, in particular, from the second electrolyte layer 62.

In this embodiment, the predetermined time Tdly is set to a time taken for the rich gas to reach the absorption device 55 after the execution of the rich spike control is started. Therefore, at a time or generally at a time when the rich gas starts flowing into the absorption device 55, the discharge of the nitrogen oxide from the absorption device 55 is started. The discharged nitrogen oxide is reduced to be purified to nitrogen ($N_2$) by using hydrocarbon (HC) included in the exhaust gas as reduction agent.

Further, the exhaust gas purification apparatus according to this embodiment terminates the execution of the rich spike control at a time when a predetermined time Tstart_th elapses after the execution of the rich spike control is started (see a time t43 in FIG. 4). Then, the exhaust gas purification apparatus stops an application of an electric voltage to the absorption device 55 at a time when a predetermined time Tdly elapses (see a time t44 of FIG. 4) from the time of the termination of the execution of the rich spike control (see a time t43 of FIG. 4). The predetermined time Tdly is set to a time taken for the exhaust gas not having an air/fuel ratio richer than the stoichiometric air/fuel ratio, in this embodiment, in particular, the exhaust gas having an air/fuel ratio leaner than the stoichiometric air/fuel ratio resulted from the termination of the execution of the rich spike control. Therefore, at a time or generally at a time when the exhaust gas not having an air/fuel ratio richer than the stoichiometric air/fuel ratio starts flowing into the absorption device 55, the application of the electric voltage between the first and second electrode layers 61 and 62 is stopped. Therefore, at a time or generally at a time when the exhaust gas not having an air/fuel ratio richer than the stoichiometric air/fuel ratio starts flowing into the absorption device 55, the discharge of the nitrogen oxide from the absorption device 55 is stopped.

The summary of the NOx purification control executed by the exhaust gas purification apparatus according to this embodiment has been described. According to this NOx purification control, the discharge of the nitrogen oxide from the second electrode layer 62, that is, from the oxygen ion conductor at the same time as the satisfaction of a purification condition that the absorption device 55 can purify the nitrogen oxide, that is, a condition that it can be estimated that the execution of the rich spike control is started and thus, the air/fuel of the exhaust gas flowing into the absorption device 55 is made to be richer than the stoichiometric air/fuel ratio. On the other hand, the discharge of the nitrogen oxide from the second electrode layer 62 is stopped at the same time as the rejection of the satisfaction of the purification condition. Thus, the nitrogen oxide discharged from the engine 10 can be purified at a high purification rate.

<Concrete NOx Purification Control by Exhaust Gas Purification Device>

Next, a concrete NOx purification control executed by the exhaust gas purification apparatus will be described. The CPU of the ECU 80 is programmed or configured to start executions of control routines shown by flowcharts in FIGS. 5 to 7 as the NOx purification control each time a predetermined time elapses.

Figure 5:
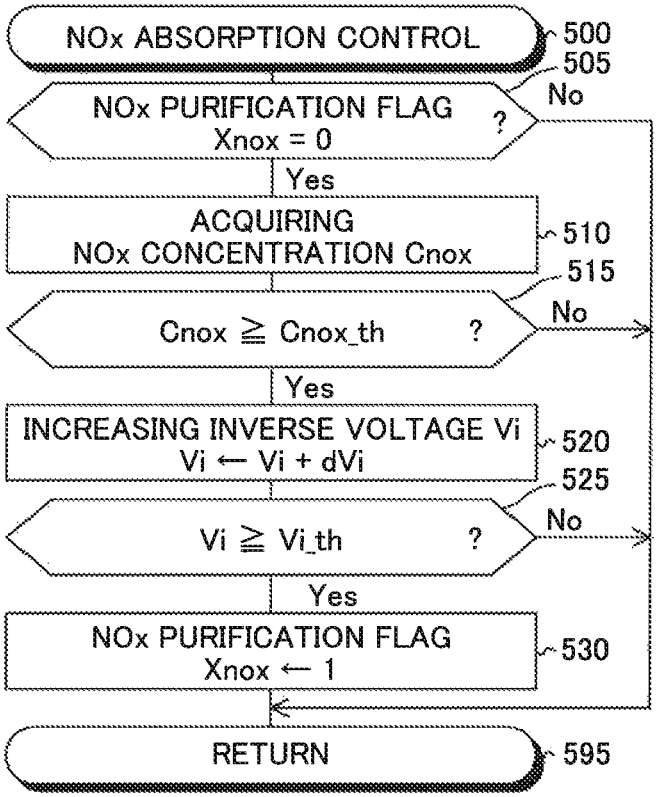
FIG. 5 shows a flowchart which illustrates a NOx absorption control routine which is executed by a CPU shown in FIG. 1.

Therefore, at a predetermined timing, the CPU starts an execution of a routine from a step 500 of FIG. 5 and then, proceeds with the process to a step 505 to determine whether or not a value of a NOx purification flag Xnox is "0". The NOx purification flag Xnox indicates whether or not the rich spike control is executed to reduce the absorbed nitrogen oxide, thereby to purify the absorbed nitrogen oxide. When the reduction purification of the absorbed nitrogen oxide is carried out by the execution of the control routines shown in FIGS. 6 and 7 described later, the value of the NOx purification flag Xnox is set to "1". On the other hand, when the reduction purification of the absorbed nitrogen oxide is not carried out, the value of the NOx purification flag Xnox is set to "0".

Now, it is assumed that the reduction purification of the absorbed nitrogen oxide is not carried out. In this case, the value of the NOx purification flag Xnox is "0". Thus, the CPU determines "Yes" at the step 505 and then, proceeds with the process to a step 510 to acquire the detected NOx concentration Cnox. The acquired NOx concentration Cnox is a NOx concentration detected by the NOx concentration sensor 75.

Then, the CPU proceeds with the process to a step 515 to determine whether or not the detected NOx concentration Cnox is equal to or larger than a predetermined concentration Cnox_th. The predetermined concentration Cnox_th is, for example, set to zero.

When the detected NOx concentration Cnox is equal to or larger than the predetermined concentration Cnox_th, the CPU determines "Yes" at the step 515 and then, proceeds with the process to a step 520. When the CPU proceeds with the process to the step 520, the CPU increases the value of the inverse electric voltage Vi applied to the absorption device 55 by a predetermined value dVi and then, proceeds with the process to a step 525.

On the other hand, when the detected NOx concentration Cnox is smaller than the predetermined concentration Cnox_th, the CPU determines "No" at the step 515 and then, proceeds with the process directly to a step 595 to terminate the execution of this routine once. In this case, the inverse electric voltage Vi is not increased.

When the CPU proceeds with the process to the step 525, the CPU determines whether or not the absolute value of the inverse electric voltage Vi increased at the step 520 is equal to or larger than a predetermined threshold electric voltage Vi_th. When the absolute value of the inverse electric voltage Vi is equal to or larger than the predetermined threshold voltage Vi_th, that is, when the predetermined enriching control start condition is satisfied, the CPU proceeds with the process to a step 530. When the CPU proceeds with the process to the step 530, the CPU sets the value of the NOx purification flag Xnox to "1" and then, proceeds with the process to the step 595 to terminate the execution of this routine once.

When the CPU proceeds with the process to the step 505 after the value of the NOx purification flag Xnox is set to "1", the CPU determines "No" at the step 505 and then, proceeds with the process directly to the step 595 to terminate the execution of this routine once.

On the other hand, when the absolute value of the inverse electric voltage Vi is smaller than the predetermined threshold voltage Vi_th upon the execution of the process of the step 525, the CPU determines "No" at the step 525 and then, proceeds with the process directly to the step 595 to terminate the execution of this routine once. In this case, the value of the NOx purification flag Xnox is maintained at "0".

Figure 6:
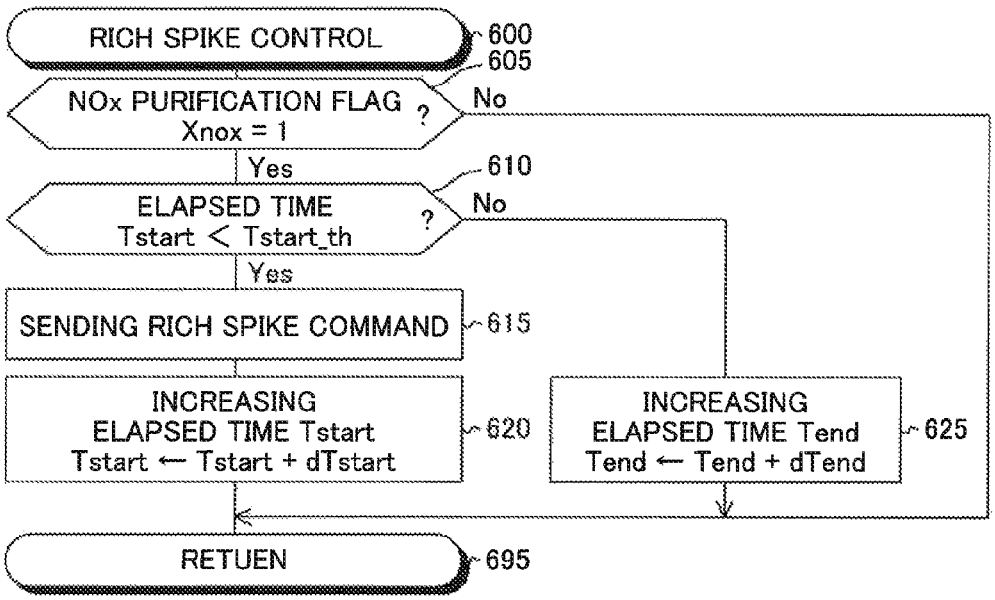
FIG. 6 shows a flowchart which illustrates a rich spike control routine which is executed by the CPU shown in FIG. 1.

Thereafter, at a predetermined timing, the CPU starts an execution of the routine from a step 600 of FIG. 6 and then, proceeds with the process to a step 605 to determine whether or not the value of the NOx purification flag Xnox is "1". When the value of the NOx purification flag Xnox is "1", the CPU determines "Yes" at the step 605 and then, proceeds with the process to a step 610 to determine whether or not an elapsed time Tstart is smaller than a predetermined time Tstart_th.

The elapsed time Tstart indicates a time elapsing from a time of starting the execution of the rich spike control. On the other hand, the predetermined time Tstart_th is previously set as a time period that the rich spike control should be continued to be executed. Therefore, in this embodiment, the rich spike control is continued to be executed for the predetermined time Tstart_th.

When the elapsed time Tstart is smaller than the predetermined time Tstart_th, the CPU determines "Yes" at the step 610 and then, sequentially executes processes of steps 615 and 620 described below.

Step 615: The CPU sends a rich spike command for causing the fuel injectors 23 to inject a predetermined amount of the fuel at the exhaust stroke in each of the combustion chambers 22.

Step 620: The CPU increases the elapsed time Tstart by a predetermined time dTstart. Then, the CPU proceeds with the process to a step 695 to terminate the execution of this routine once.

On the other hand, when the elapsed time Tstart becomes equal to or larger than the predetermined time Tstart_th while the process of the step 620 is repeatedly executed, the CPU determines "No" at the step 610 and then, proceeds with the process to a step 625 to increase an elapsed time Tend by a predetermined time dTend. Then, the CPU proceeds with the process to the step 695 to terminate the execution of this routine once. In this case, the rich spike control is not executed or the execution of the rich spike control is terminated. The elapsed time Tend indicates a time elapsing from the termination of the execution of the rich spike control.

When the value of the NOx purification flag Xnox is "0" upon the execution of the process of the step 605, the CPU determines "No" at the step 605 and then, proceeds with the process directly to the step 695 to terminate the execution of this routine once. In this case, the rich spike control is not executed.

Figure 7:
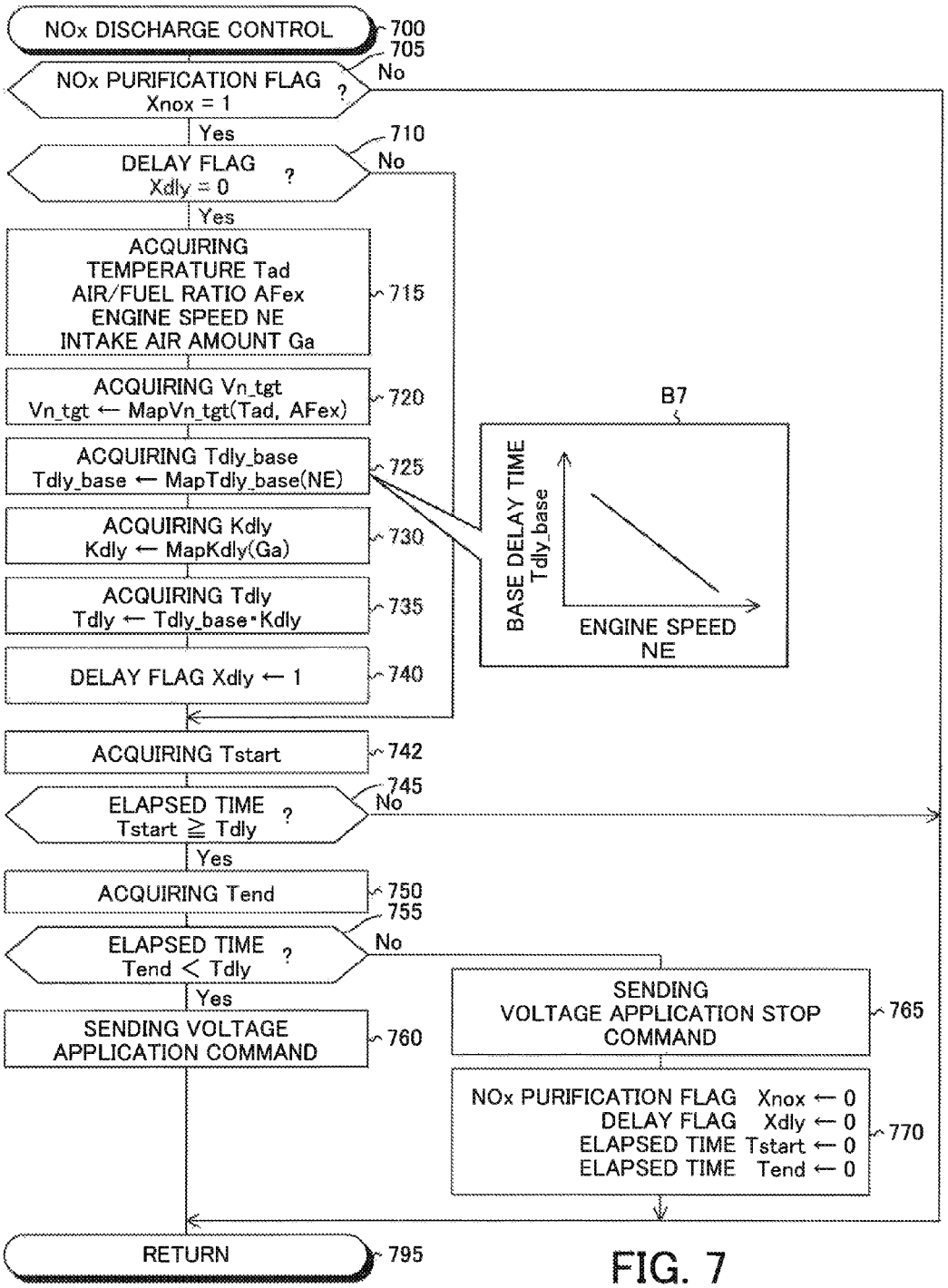
FIG. 7 shows a flowchart which illustrates a NOx discharge control routine which is executed by the CPU shown in FIG. 1.

Further, at a predetermined timing, the CPU starts an execution of the routine from a step 700 of FIG. 7 and then, proceeds with the process to a step 705 to determine whether or not the value of the NOx purification flag Xnox is "1".

When the value of the NOx purification flag Xnox is "1", the CPU determines "Yes" at the step 705 and then, proceeds with the process to a step 710 to determine whether or not a value of a delay flag Xdly is "0".

The delay flag Xdly indicates whether or not the CPU stands ready to apply an electric voltage to the absorption device 55 after the CPU starts the execution of the rich spike control. The value of the delay flag Xdly is set to "1" when the CPU stands ready to apply an electric voltage to the absorption device 55 and on the other hand, the value of the delay flag Xdly is set to "0" when the CPU stops the application of the electric voltage to the absorption device 55 after the CPU starts the application of the electric voltage.

When the value of the delay flag Xdly is "0", the CPU determines "Yes" at the step 710 and then, sequentially executes processes of steps 715 to 740 described below.

Step 715: The CPU acquires the absorption device temperature Tad, the air/fuel ratio AFex of the exhaust gas detected by the air/fuel ratio sensor 74, the engine speed NE and the intake air amount Ga. Hereinafter, the air/fuel ratio AFex of the exhaust gas detected by the air/fuel ratio sensor 74 will be referred to as "the inflow exhaust gas air/fuel ratio AFex".

It should be noted that in this embodiment, the absorption device temperature Tad is acquired by a known method using an impedance calculated on the basis of the electric current flowing through the solid electrolyte layer 60 when a first condition of connecting the first switch 65 to the terminal 65*a* and connecting the second switch 66 to the terminal 66*a* is formed for an extremely short time or when a second condition of connecting the first switch 65 to the terminal 65*b* and connecting the second switch 66 to the terminal 66*b* is formed for an extremely short time.

Alternatively, in this embodiment, the absorption device temperature Tad is acquired by a known method using an admittance calculated on the basis of the electric current flowing through the solid electrolyte layer 60 when switching the aforementioned first and second conditions at an extremely short cycle.

Step 720: The CPU applies the absorption device temperature Tad and the inflow exhaust gas air/fuel ratio AFex to a look-up table MapVn_tgt(Tad,AFex) to acquire a target value Vn_tgt of the normal electric voltage Vn to be applied to the absorption device 55. Hereinafter, the target value Vn_tgt will be referred to as "the target normal voltage Vn_tgt".

In this connection, as the absorption device temperature Tad increases, the absorbed nitrogen oxide is likely to desorb from the absorption device 55. Therefore, if the normal electric voltage Vn applied to the absorption device 55 is large when the absorption device temperature Tad is high, a large amount of the absorbed nitrogen oxide desorbs from the absorption device 55 and the desorbing nitrogen oxide cannot be purified. Thus, according to the look-up table MapVn_tgt(Tad,AFex), as the absorption device temperature Tad increases, the acquired target normal voltage Vn_tgt decreases.

In addition, as the inflow exhaust gas air/fuel ratio AFex decreases when the inflow exhaust gas air/fuel ratio AFex is smaller (i.e., richer) than the stoichiometric air/fuel ratio, the absorbed nitrogen oxide is likely to desorb from the absorption device 55. Therefore, if the normal electric voltage Vn applied to the absorption device 55 is large when the inflow exhaust gas air/fuel ratio AFex is small, a large amount of the absorbed nitrogen oxide desorbs from the absorption device 55 and the desorbing nitrogen oxide cannot be purified. Thus, according to the look-up table MapVn_tgt (Tad,AFex), as the inflow exhaust gas air/fuel ratio AFex decreases when the inflow exhaust gas air/fuel ratio AFex is smaller than the stoichiometric air/fuel ratio, the acquired target normal voltage Vn_tgt decreases.

Step 725: The CPU applies the engine speed NE to a look-up table MapTdly_base(NE) to acquire a base delay time Tdly_base. The base delay time Tdly_base is a base value for acquiring a time that the CPU has stood ready to apply an electric voltage to the absorption device 55 after the CPU starts the execution of the rich spike control.

Further, as the engine speed NE increases, a time taken for the exhaust gas discharged from the combustion chamber 22 to reach the absorption device 55 decreases. Thus, as shown in a block B7 in FIG. 7, according to the look-up table MapTdly_base(NE), as the engine speed NE increases, the base delay time Tdly_base decreases.

Step 730: The CPU applies the intake air amount Ga to a look-up table MapKdly(Ga) to acquire a correction coefficient Kdly. The correction coefficient Kdly is used to be multiplied to the base delay time Tdly_base to correct the base delay time Tdly_base at a step 735 described later.

In this connection, as the intake air amount Ga increases, a time taken for the exhaust gas discharged from the combustion chamber 22 to reach the absorption device 55 decreases. Thus, according to the look-up table MapKdly (Ga), the acquired correction coefficient Kdly is a positive value and decreases as the intake air amount Ga increases.

Step 735: The CPU multiplies the base delay time Tdly_base by the correction coefficient Kdly to acquire a delay time Tdly (Tdly=Tdly_base×Kdly).

Step 740: The CPU sets the value of the delay flag Xdly to "1". Then, the CPU proceeds with the process to a step 742.

It should be noted that when the CPU proceeds with the process to the step 710 after the value of the delay flag Xdly is set to "1" at the step 740, the CPU determines "No" at the step 710 and then, proceeds with the process directly to the step 742.

When the CPU proceeds with the process to the step 742, the CPU acquires the elapsed time Tstart and then, proceeds with the process to a step 745. The elapsed time Tstart corresponds to a time elapsing from a time of starting the execution of the rich spike control and is increased at the step 620 in FIG. 6.

When the CPU proceeds with the process to the step 745, the CPU determines whether or not the elapsed time Tstart is equal to or larger than the delay time Tdly. When the elapsed time Tstart is smaller than the delay time Tdly, the CPU determines "No" at the step 745 and then, proceeds with the process directly to a step 795 to terminate the execution of this routine once.

On the other hand, when the elapsed time Tstart is equal to or larger than the delay time Tdly, the CPU determines "Yes" at the step 745 and then, proceeds with the process to a step 750 to acquire the elapsed time Tend. The elapsed time Tend corresponds to a time elapsing from a time of terminating the execution of the rich spike control and is increased at the step 625 in FIG. 6.

Next, the CPU proceeds with the process to a step 755 to determine whether or not the elapsed time Tend is smaller than the delay time Tdly. When the elapsed time Tend is smaller than the delay time Tdly, the CPU determines "Yes" at the step 755 and then, proceeds with the process to a step 760.

When the CPU proceeds with the process to the step 760, the CPU sends a command for applying the target normal voltage Vn_tgt of the normal electric voltage between the first and second electrode layers 61 and 62. Then, the CPU proceeds with the process to the step 795 to terminate the execution of this routine once.

On the other hand, when the elapsed time Tend is equal to or larger than the predetermined time Tdly upon the execution of the process of the step 755, the CPU determines "No" at the step 755 and then, sequentially execute processes of steps 765 and 770 described below.

Step 765: The CPU sends a command for stopping the application of the electric voltage to the absorption device 55.

Step 770: The CPU sets the values of the NOx purification flag Xnox and the delay flag Xdly to "0", respectively and clears the elapsed times Tstart and Tend, respectively. Then, the CPU proceeds with the process to the step 795 to terminate the execution of this routine once.

It should be noted that when the value of the NOx purification flag Xnox is "0" upon the execution of the process of the step 705, the CPU determines "No" at the step 705 and then, proceeds with the process directly to the step 795 to terminate the execution of this routine once. In this case, the NOx discharge control for discharging the absorbed nitrogen oxide from the absorption device 55 is not executed.

The concrete NOx purification control executed by the exhaust gas purification apparatus has been described. According to the NOx purification control, the nitrogen oxide discharged from the engine 10 is absorbed in the absorption device 55 and the absorbed nitrogen oxide is purified at a high purification rate.

Modified Example

In the above-described embodiment, a timing that the rich gas reaches the absorption device 55 after the execution of the rich spike control is started, that is, a timing that the elapsed time Tstart becomes equal to the delay time Tdly, is estimated on the basis of the engine speed NE and the intake air amount Ga. Alternatively, the timing that the rich gas reaches the absorption device 55 may be determined by a method described below.

The inventors of this application have realized that if a closed circuit including the second electrolyte layer 62, the solid electrolyte layer 60 and the first electrode layer 61 is formed when the rich gas reaches the absorption device 55, an electric current flows through the closed circuit due to oxidation reaction (i.e., combustion reaction) of the hydrocarbon included in the rich gas even when no electric voltage is applied between the first and second electrode layers 61 and 62.

The reason that the electric current flows as such is estimated as follows. When the rich gas reaches the absorption device 55, the silver included in the second electrode layer 62 acts as a catalyst for burning the hydrocarbon included in the rich gas and thus, the hydrocarbon included in the rich gas is oxidized (i.e., burned) around the second electrolyte layer 62. At this time, a chemical reaction shown by a following chemical reaction formula (5) proceeds.

$$2C_xH_y+(4x+y)O^{2-}\rightarrow 2xCO_2+yH_2O+(8x+2y)e^- \quad (5)$$

When this chemical reaction proceeds at the second electrolyte layer 62, the oxygen ions move through the solid electrolyte layer 60 from the first electrode layer 61 toward the second electrode layer 62 and the electrons are discharged at the second electrolyte layer 62. Thereby, it is estimated that if the closed circuit including the second electrolyte layer 62, the solid electrolyte layer 60 and the first electrode layer 61 is formed when the electric voltage is not applied between the first and second electrode layers 61 and 62, the electric current flows through the closed circuit.

Figure 8A:
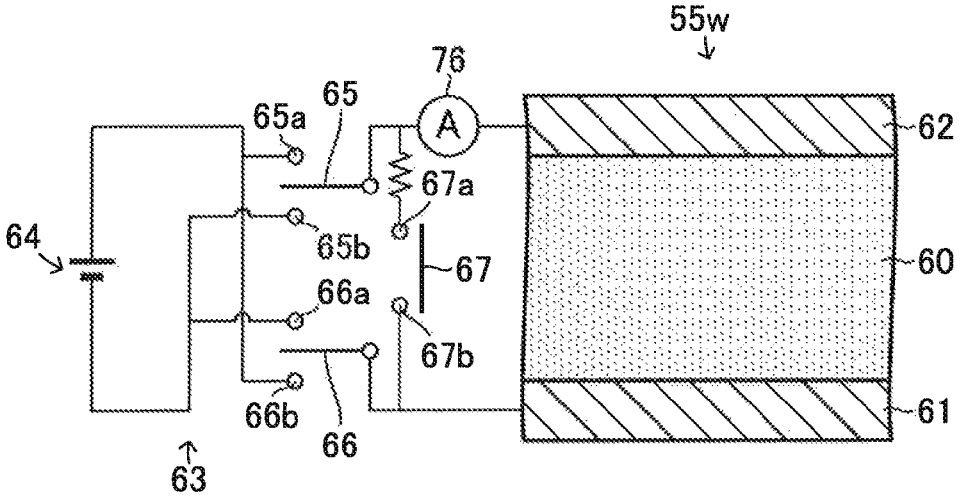
FIG. 8(A) shows an enlarged sectional view of a partition wall of an electric NOx absorption/discharge device according to a modified example of the embodiment when no closed circuit including electrode layers and a solid electrolyte layer is formed.
Figure 8B:
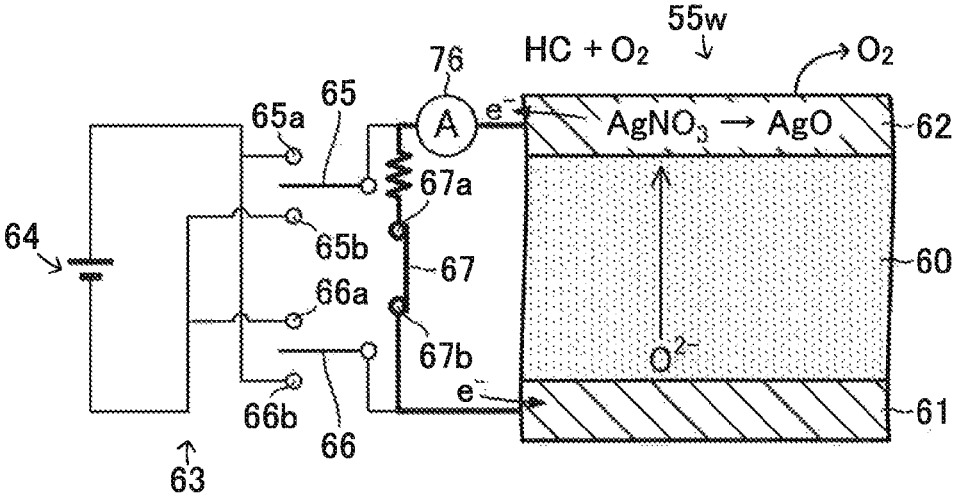
FIG. 8(B) shows an enlarged sectional view of the partition wall of the electric NOx absorption/discharge device according to the modified example of the embodiment when a closed circuit including the electrode layers and the solid electrolyte layer is formed.

On the basis of this realization of the inventors of this application, as shown in FIG. 8(A), the electric power source circuit 63 of the absorption device 55 according to the modified example includes a third switch 67 and a resistance 68 in addition to the elements of the electric power source circuit 63 according to the embodiment. As shown in FIG. 8(B), the exhaust gas purification apparatus according to the modified example electrically connects a terminal 67*a* to a terminal 67*b* by the third switch 67 at least at a time of starting the execution of the rich spike control.

Thereby, when the rich gas reaches the absorption device 55, the electric current flows sequentially through the second electrolyte layer 62, the solid electrolyte layer 60, the first electrode layer 61, the third switch 67, the resistance 68 and the ammeter 76. The exhaust gas purification apparatus according to the modified example is configured to apply the normal electric voltage Vn between the first and second electrode layers 61 and 62 at the time when the electric current detected by the ammeter 76 becomes equal to or larger than a predetermined current value which is larger than zero.

Thereby, it is possible to accurately determine the time when the rich gas reaches the absorption device 55.

It should be noted that according to the modified example, measured is a time T1 from a time when the execution of the rich spike control is started to a time when the electric current detected by the ammeter 76 becomes equal to or larger than the predetermined current value. Further, when a time elapsing from the termination of the execution of the rich spike control reaches the time T1, the application of the normal electric voltage Vn between the first and second electrode layers 61 and 62 is stopped.

Further, the present disclosure is not limited to the above-described embodiment and modified example and various modified examples may be employed. For example, the present disclosure can be applied to an exhaust gas purification apparatus of the engine 10 shown in FIG. 9.

The exhaust gas purification apparatus 53 shown in FIG. 9 includes a selective reduction type NOx catalyst (hereinafter, will be referred to as "the SCR catalyst") 57 in addition to the absorption device 55 and the DPF 56 described above. The SCR catalyst 57 is provided in the exhaust pipe 52 between the absorption device 55 and the DPF 56.

A urea aqueous addition device 58 includes a urea aqueous tank 58*a*, a first connection pipe 58*b*, a urea aqueous pressurizing device 58*c*, a second connection pipe 58*d* and a urea aqueous injector 58*e*. The first connection pipe 58*b* connects the urea aqueous tank 58*a* to the urea aqueous pressurizing device 58*c* in communication manner. The second connection pipe 58*d* connects the urea aqueous pressurizing device 58*c* to the urea aqueous injector 58*e* in communication manner. The urea aqueous injector 58*e* is provided in the exhaust pipe 52 between the absorption device 55 and the SCR catalyst 57.

The urea aqueous injector 58*e* injects urea aqueous reserved in the urea aqueous tank 58*a* into the exhaust pipe 52 in response to a command sent from the ECU 80. Thereby, the urea aqueous is supplied to the SCR catalyst 57. The urea aqueous supplied to the SCR catalyst 57 is converted to ammonia ($NH_3$) through hydrolysis reaction shown by a following formula (6).

$$CO(NH_2)_2+H_2O\rightarrow 2NH_3+CO_2 \quad (6)$$

The nitrogen oxide flowing into the SCR catalyst 57 is reduced to be purified by the SCR catalyst 57 using the ammonia produced from the urea aqueous as reduction agent through any of chemical reactions shown by following formulas (7) to (9).

$$4NO+4NH_3+O_2 \rightarrow 4N_2+6H_2O \quad (7)$$

$$NO+NO_2+2NH_3 \rightarrow 2N_2+3H_2O \quad (8)$$

$$6NO_2+8NH_3 \rightarrow 7N_2+12H_2O \quad (9)$$

In this example, when a temperature of the SCR catalyst 57 is lower than an activation temperature, that is, when a purification rate correlation value correlating with the NOx purification rate of the SCR catalyst 57 is smaller than a predetermined purification rate correlation value, the exhaust gas purification apparatus does not apply an electric voltage between the first and second electrode layers 61 and 62. Hereinafter, the temperature of the SCR catalyst 57 will be referred to as "the catalyst temperature".

In addition, when an amount of the ammonia absorbed in the SCR catalyst 57 is smaller than an amount capable of sufficiently purifying the nitrogen oxide, that is, when the purification rate correlation value is smaller than the predetermined purification correlation value, the exhaust gas purification apparatus does not apply an electric voltage between the first and second electrode layers 61 and 62. Hereinafter, the amount of the ammonia absorbed in the SCR catalyst 57 will be referred to as "the absorbed ammonia amount".

In this connection, similar to the embodiment described above, the exhaust gas purification apparatus may apply the inverse electric voltage between the first and second electrode layers 61 and 62 as necessity in order to prevent the desorption of the nitrogen oxide from the second electrolyte layer 62.

When the catalyst temperature becomes higher than the activation temperature and the absorbed ammonia amount becomes equal to or larger than the amount capable of sufficiently purifying the nitrogen oxide, that is, when the purification rate correlation value is equal to or larger than the predetermined purification rate correlation value and a purification condition that the SCR catalyst 57 can purify the nitrogen oxide is satisfied, the exhaust gas purification apparatus applies a normal electric voltage Vn between the first and second electrode layers 61 and 62. As a result, the nitrogen oxide is discharged from the second electrode layer 62 and flows out from the absorption device 55 into the exhaust pipe 52 downstream of the absorption device 55. This NOx flows into the SCR catalyst 57 and is purified by the SCR catalyst 57.

On the other hand, when the catalyst temperature becomes lower than the activation temperature and thus, the purification condition becomes unsatisfied, the exhaust gas purification apparatus stops the application of the normal electric voltage between the first and second electrode layers 61 and 62. Also, when the absorbed ammonia amount becomes smaller than the amount capable of sufficiently purifying the nitrogen oxide and thus, the purification condition becomes unsatisfied, the exhaust gas purification apparatus stops the application of the normal electric voltage between the first and second electrode layers 61 and 62. As a result, the discharge of the nitrogen oxide from the second electrode layer 62 stops.

Figure 9:
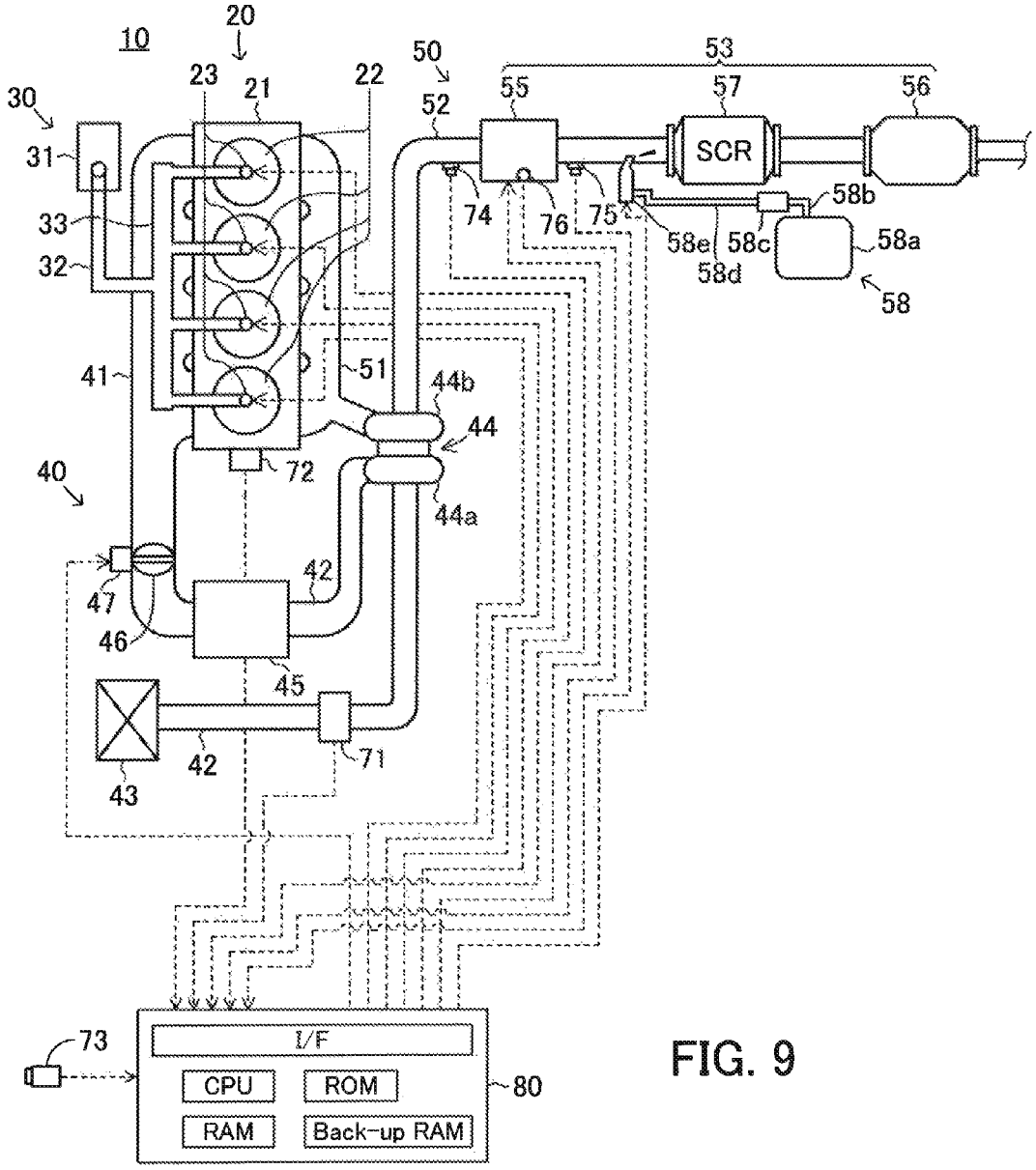
FIG. 9 shows a general view of an internal combustion engine provided with an exhaust gas purification apparatus according to the modified example of the embodiment.

Thereby, also when the exhaust gas purification apparatus according to the present disclosure is applied to the engine 10 shown in FIG. 9, the nitrogen oxide can be purified at a high purification rate.

It should be noted that when the exhaust gas purification apparatus according to the present disclosure is applied to the engine 10 shown in FIG. 9, the temperature of the SCR catalyst 57 can be acquired, for example, on the basis of an output of a temperature sensor provided in the SCR catalyst 57. Further, the amount of the ammonia absorbed in the SCR catalyst 57 can be calculated, for example, on the basis of an amount of the urea aqueous injected from the urea aqueous injector 58*e* and an amount of the nitrogen oxide flowing into the SCR catalyst 57 (or an amount of the ammonia consumed by the SCR catalyst 57).

The rich spike control according to the above-described embodiment is one of enriching controls for making the air/fuel ratio of the exhaust gas flowing into the absorption device 55 richer than the stoichiometric air/fuel ratio. The enriching control according to the present disclosure is not limited and, for example, may be a control for making the air/fuel ratio of the exhaust gas flowing into the absorption device 55 richer than the stoichiometric air/fuel ratio by injecting reduction agent by a reduction agent injection device for injecting reduction agent (for example, hydrocarbon) into the exhaust pipe 52 upstream of the absorption device 55.

Further, the second electrode layer 62 according to the above-described embodiment may include alkali metal such as potassium and/or alkali earth metal such as barium in addition to the silver.

Further, as described above, the solid electrolyte layer 60 may be a layer formed of zirconia-based electrolyte such as scandia stabilized zirconia (ScSZ) and yttria stabilized zirconia (YSZ). However, the solid electrolyte layer 60 may be a layer formed of ceria-based electrolyte such as gadolinia-doped ceria (GDC).

According to the above-described embodiment, the execution of the rich spike control is started when the absolute value of the inverse electric voltage Vi is equal to or higher than the predetermined threshold voltage Vi_th. Alternatively, if the absolute value of the inverse electric voltage Vi is lower than the predetermined threshold voltage Vi_th, the execution of the rich spike control may be started when the estimated amount of the nitrogen oxide absorbed in the absorption device 55 reaches a predetermined absorbed nitrogen oxide amount (i.e., when the predetermined enriching control start condition becomes satisfied). In this case, the predetermined absorbed nitrogen oxide amount is set, for example, to an upper limit value of the amount of the nitrogen oxide which the absorption device 55 can absorb.

In addition, the exhaust gas purification apparatus according to the present disclosure can be applied to a multi-cylinder four-cycle piston-reciprocating spark-ignition type gasoline engine.

What is claimed is:

1. An exhaust gas purification apparatus of an internal combustion engine, comprising:

an oxygen ion conductor formed of oxygen ion conductive material which can conduct oxygen ions when an electric voltage is applied to the oxygen ion conductive material;

a NOx absorption/discharge device provided in an exhaust passage of the engine, the NOx absorption/discharge device being formed by a first electrode provided on a first surface of the oxygen ion conductor and a second electrode including silver and provided on a second surface of the oxygen ion conductor opposite to the first surface across the oxygen ion conductor;

a NOx purification catalyst provided in the exhaust passage downstream of the NOx absorption/discharge device, an electric voltage source for applying an electric voltage between the first electrode and the second electrode; and an electronic control unit configured to control an operation of the electric voltage source to apply an electric voltage between the first electrode and second electrode such that oxygen ions move through the oxygen ion conductor from the first electrode toward the second electrode when a purification condition that nitrogen oxide discharged from the NOx absorption/discharge device can be purified in the exhaust passage is satisfied;

wherein the electronic control unit is configured to determine that the purification condition is satisfied when a purification rate correlation value correlating with a NOx purification rate of the NOx purification catalyst is equal to or larger than a predetermined purification rate correlation value;

wherein the purification rate correlation value when the NOx purification rate corresponds to a first purification rate, is smaller than the purification rate correlation value when the NOx purification rate corresponds to a second purification rate larger than the first purification rate.

2. The exhaust gas purification apparatus according to claim 1, wherein the electronic control unit is configured:

to execute an enriching control for making an air/fuel ratio of the exhaust gas flowing into the NOx absorption/discharge device richer than the stoichiometric air/fuel ratio when a predetermined enriching control start condition is satisfied; and to determine that the purification condition is satisfied when a rich air/fuel ratio condition is satisfied, the rich air/fuel ratio condition is satisfied when it is estimated that the air/fuel of the exhaust gas flowing into the NOx absorption/discharge device is made to be richer than the stoichiometric air/fuel ratio by the execution of the enriching control.

3. The exhaust gas purification apparatus according to claim 2, wherein the electronic control unit is configured to determine that the rich air/fuel ratio condition is satisfied when an electric current flowing between the first electrode and the second electrode is equal to or larger than a predetermined current value after the execution of the enriching control is started.

4. The exhaust gas purification apparatus according to claim 1, wherein the electronic control unit is configured to apply the electric voltage between the first electrode and the second electrode by using the electric voltage source such that oxygen ions move through the oxygen ion conductor from the second electrode toward the first electrode when the purification condition is not satisfied.

5. An exhaust gas purification apparatus of an internal combustion engine, comprising:

an oxygen ion conductor formed of oxygen ion conductive material which can conduct oxygen ions when an electric voltage is applied to the oxygen ion conductive material;

a NOx absorption/discharge device provided in an exhaust passage of the engine, the NOx absorption/discharge device being formed by a first electrode provided on a first surface of the oxygen ion conductor and a second electrode including silver and provided on a second surface of the oxygen ion conductor opposite to the first surface across the oxygen ion conductor;

an electric voltage source for applying an electric voltage between the first electrode and the second electrode; and an electronic control unit configured to control an operation of the electric voltage source to apply an electric voltage between the first electrode and second electrode such that oxygen ions move through the oxygen ion conductor from the first electrode toward the second electrode when a purification condition that nitrogen oxide discharged from the NOx absorption/discharge device can be purified in the exhaust passage is satisfied; and the electronic control unit is configured to apply the electric voltage between the first electrode and the second electrode by using the electric voltage source such that oxygen ions move through the oxygen ion conductor from the second electrode toward the first electrode when the purification condition is not satisfied.

6. The exhaust gas purification apparatus according to claim 5, wherein the electronic control unit is configured:

to execute an enriching control for making an air/fuel ratio of the exhaust gas flowing into the NOx absorption/discharge device richer than the stoichiometric air/fuel ratio when a predetermined enriching control start condition is satisfied; and to determine that the purification condition is satisfied when a rich air/fuel ratio condition is satisfied, the rich air/fuel ratio condition is satisfied when it is estimated that the air/fuel of the exhaust gas flowing into the NOx absorption/discharge device is made to be richer than the stoichiometric air/fuel ratio by the execution of the enriching control.

7. The exhaust gas purification apparatus according to claim 6, wherein the electronic control unit is configured to determine that the rich air/fuel ratio condition is satisfied when an electric current flowing between the first electrode and the second electrode is equal to or larger than a predetermined current value after the execution of the enriching control is started.

* * * * *